United States Patent [19]

Bamrungbhuet et al.

[11] Patent Number: 4,999,970

[45] Date of Patent: Mar. 19, 1991

[54] APPARATUS FOR MAKING CIGARETTE PACKS AND THE LIKE

[75] Inventors: Samutt Bamrungbhuet, Reinbek; Reinhard Deutsch, Geesthacht; Harry David, Hamburg; Gottfried Hoffmann, Schwarzenbek; Otto Erdmann, Hamburg, all of Fed. Rep. of Germany

[73] Assignee: Körber AG, Hamburg, Fed. Rep. of Germany

[21] Appl. No.: 378,862

[22] Filed: Jul. 12, 1989

[30] Foreign Application Priority Data

Jul. 18, 1988 [DE] Fed. Rep. of Germany ..... 3824316

[51] Int. Cl.[5] ..... B65B 11/32; B65B 11/58

[52] U.S. Cl. ..... 53/176; 53/225; 53/234

[58] Field of Search ..... 53/225, 232, 233, 234, 53/575, 579, 170, 172, 176

[56] References Cited

U.S. PATENT DOCUMENTS

| | | | |
|---|---|---|---|
| 2,558,368 | 6/1951 | Malhiot | 53/579 |
| 2,870,584 | 1/1959 | Sherrill | 53/575 X |
| 4,006,577 | 2/1977 | Schoppee | 53/234 X |
| 4,330,976 | 5/1982 | Blackall | 53/575 X |
| 4,367,618 | 1/1983 | Focke | 53/234 |
| 4,408,435 | 10/1983 | Sutton | 53/234 X |
| 4,548,019 | 10/1985 | Kruse | 53/239 X |
| 4,866,912 | 9/1989 | Deutsch | 53/176 X |

*Primary Examiner*—John Sipos

*Attorney, Agent, or Firm*—Peter K. Kontler

[57] ABSTRACT

The making of cigarette packs is started by transferring arrays of cigarettes into successive pockets of a transporting unit while the pockets are at a standstill, and by inserting blanks into discrete pouches which are adjacent the front sides of the pockets. The pouches and the pockets are then accelerated, and the blanks are partially folded to overlie the arrays of cigarettes in the adjacent pockets prior to joint transfer of arrays and blanks into the receptacles of a continuously driven endless chain conveyor. The arms are then decelerated whereby the chain conveyor extracts the trailing portions of the blanks from their pouches and the blanks are converted stepwise into inner envelopes. The making of second envelopes around the inner envelopes can begin prior to or after completion of inner envelopes.

23 Claims, 7 Drawing Sheets

APPARATUS FOR MAKING CIGARETTE PACKS AND THE LIKE

CROSS-REFERENCE TO RELATED CASE

The packing machine of the present invention is similar to that which is disclosed in commonly owned copending patent application Ser. No. 07/378,864 filed July 12, 1989 by Harry David for "Method of making cigarette packs and the like".

BACKGROUND OF THE INVENTION

The invention relates to improvements in apparatus for making block-shaped products, particularly packs which contain plain or filter cigarettes or other rod-shaped articles of the tobacco processing industry. More particularly, the invention relates to improvements in machines for draping foldable blanks of paper, cardboard, plastic foil, metallic foil (e.g., aluminum or tin foil) and/or other suitable material around block-shaped arrays of rod-shaped articles of the tobacco processing industry, such as plain or filter cigarettes, cigars, cigarillos and cheroots.

A drawback of presently known packing machines for plain or filter cigarettes or other rod-shaped articles of the tobacco processing industry is that the machines must employ a large number of folding members because each of two or more blanks which are converted into envelopes around arrays of rod-shaped articles must be individually folded until its conversion into an envelope is completed. Thus, if a cigarette pack is to have an inner envelope of metallic foil and an outer envelope of paper or cardboard, the conversion of a first blank into the inner envelope must always be completed before the making of the second or outer envelope can begin. This not only necessitates the provision of a large number of folding members and other parts (such as the means for moving certain folding members with reference to the blanks) but also prolongs the interval which is required to complete the making of a pack.

OBJECTS OF THE INVENTION

An object of the invention is to provide a novel and improved machine which can drape metallic and/or other blanks around arrays of rod-shaped articles of the tobacco processing industry.

Another object of the invention is to provide a machine which can complete the making of cigarette packs and similar products within shorter intervals of time than heretofore known machines.

A further object of the invention is to provide a machine which can be used for the making of cigarette packs and like products each of which is to be provided with a single envelope, with two envelopes or with more than two envelopes.

An additional object of the invention is to provide the machine with novel and improved means for supplying, feeding and/or otherwise delivering metallic and/or nonmetallic blanks to the arrays of rod-shaped articles which are to be confined in envelopes.

Still another object of the invention is to provide the machine with novel and improved means for positioning blanks with reference to the arrays of rod-shaped articles preparatory to and during conversion of blanks into envelopes.

Another object of the invention is to provide the packing machine with a novel and improved arrangement of folding instrumentalities for metallic and/or other blanks and with novel and improved devices for conveying and otherwise manipulating arrays of rod-shaped articles during conversion of such arrays and blanks into cigarette packs or analogous products.

A further object of the invention is to provide the machine with novel and improved means for feeding and/or otherwise manipulating blanks which are to be converted into envelopes of cigarette packs or the like.

An additional object of the invention is to provide a machine which can be readily converted for the making of packs having one, two or more envelopes for arrays of rod-shaped articles.

Another object of the invention is to provide the machine with novel and improved means for moving pockets with arrays of rod-shaped articles jointly with and relative to each other.

A further object of the invention is to provide the machine with novel and improved means for simultaneously manipulating a plurality of blanks during conversion into envelopes of cigarette packs or the like.

SUMMARY OF THE INVENTION

The invention resides in the provision of a packing machine which is used to make cigarette packs or analogous packs from flexible blanks and block-shaped commodities including arrays of rod-shaped articles of the tobacco processing industry. The improved packing machine comprises a series of pockets for discrete commodities, means for transporting the pockets in a predetermined direction along a first path, a pouch provided on the transporting means in substantial parallelism with that side of each pocket which extends substantially transversely of the predetermined direction, and means for supplying blanks into the pouches along a second path. The blanks can constitute thin sheet-like blanks (e.g., blanks of metallic foil such as aluminum foil or tin foil), and the pouches preferably define narrow flat compartments for discrete blanks. Each pouch is preferably adjacent the side of a different pocket, i.e., each pocket is adjacent a discrete pouch. The aforementioned sides are preferably the front sides of the respective pockets, i.e., those sides which face in the predetermined direction.

The second path crosses a predetermined portion of the first path, and the supplying means is preferably adjacent such predetermined portion of of the first path so that a pouch which enters the predetermined portion of the first path is aligned with and is ready to receive a blank from the supplying means.

The blanks are dimensioned in such a way that each blank has a portion which projects from the respective pouch, and the machine further comprises preferably stationary folding means adjacent the first path downstream of the predetermined portion (i.e., downstream of the supplying means) and being operative to fold projecting portions of blanks in the pouches. In other words, portions of the blanks are or can be folded while major parts or substantial parts of the blanks are still confined in the respective pouches.

The machine further comprises means for delivering commodities into successive pockets in a first portion of the first path (preferably upstream of the predetermined portion where the pouches receive blanks from the supplying means), and means for expelling commodities from successive pockets in a second portion of the first path downstream of the predetermined portion. The expelling means can comprise discrete pushers in the pockets and means for moving the pushers with reference to the respective pockets. The transporting means preferably includes means for arresting successive pockets in the first portion of the first path so that the pockets are at a stillstand during reception of commodities from the delivering means, and for continuously advancing successive pockets along the second portion of the first path so that the pockets are in motion during expulsion of the respective commodities.

The machine further comprises a (first) conveyor (e.g., an endless chain conveyor) having a succession of (first) receptacles and means (e.g., one or more sprocket wheels) for moving the receptacles along a third path having a (predetermined first) portion adjacent the second portion of the first path. Successive receptacles which enter the predetermined portion of the third path are in register with successive pockets entering the second portion of the first path, and the pushers are operative to expel commodities from the respective pockets into registering receptacles. The aforementioned folding means is designed to fold projecting portions of blanks over the commodities in the respective pockets during transport of pockets and commodities from the predetermined to the second portion of the first path so that the folded blanks are expelled from their pouches into the receptacles in the predetermined portion of the third path jointly with the respective commodities. The moving means of the first conveyor includes means for continuously moving the receptacles along the third path, and the machine further comprises preferably rotary (first) conveyor means having a plurality of second receptacles and means for continuously moving the second receptacles along an endless fourth path having a (first) portion adjacent a second portion of the third path. The first conveyor of such machine further comprises means for expelling commodities and blanks from first receptacles in the second portion of the third path into second receptacles in the first portion of the fourth path.

The first conveyor preferably comprises a concave first section which defines the predetermined first portion of the third path and overlies the second portion of the first path, and a concave second section which defines the second portion of the third path and overlies the first portion of the fourth path.

The transporting means preferably defines an endless first path and includes discrete arms or other suitable transporting elements for individual pockets. Such transporting means further comprises means for driving the transporting elements at a varying speed along the first path, particularly in such a way that the transporting elements and the respective pockets are accelerated from zero speed to the speed of the first conveyor between the first and second portions of the first path and are thereupon decelerated to zero speed on their way from the second toward the first portion of the first path. The means for moving the first receptacles along the endless third path is preferably designed to move the first receptacles at a predetermined speed which matches the speed of transporting elements and their respective pockets along (and preferably at least slightly beyond) the second portion of the first path.

The (second) receptacles of the rotary (first) conveyor means are preferably provided in the peripheral surface and extend substantially radially inwardly toward the axis of rotation of the conveyor means and are spaced apart from each other in the direction of rotation of the conveyor means. The aforementioned first conveyor can be said to constitute a means for transferring commodities and blanks from the intermittently driven pockets into the (second) receptacles of the rotary conveyor means, and the machine further comprises a source of second blanks (e.g., blanks which are made of paper, lightweight cardboard or plastic foil), one or more endless belts and/or rollers or other suitable means for feeding second blanks to the peripheral surface of the conveyor means between successive second receptacles, means (e.g., including one or more rollers) for removing successively fed second blanks from the peripheral surface of the conveyor means, and means for returning the removed second blanks to the conveyor means so that each returned second blank overlies the peripheral surface and one of the second receptacles, namely a second receptacle which is to receive a commodity and a blank moving along the second path. At least one of the removing and returning means defines for second blanks an additional path having an inlet and an outlet at different parts of the endless fourth path which is defined by the first conveyor means. As mentioned above, the removing means can comprise at least one roller, and the returning means can also comprise one or more rollers.

The machine can further comprise a second endless conveyor (e.g., a chain conveyor identical with or analogous to the first conveyor) having third receptacles and means for continuously moving the third receptacles along an endless fifth path having a first portion adjacent a second portion of the fourth path (defined by the first endless conveyor means), and means for expelling commodities and blanks from the second receptacles (of the first endless conveyor means) into the third receptacles (of the second endless conveyor). As mentioned above, second blanks can be fed into the fourth path, and such blanks are then transferred into the third receptacles (on the second endless conveyor). Such machine can further comprise second rotary conveyor means including fourth receptacles and means for continuously moving the fourth receptacles along an endless sixth path having a first portion adjacent a second portion of the fifth path, means for expelling commodities and blanks from third receptacles into fourth receptacles, means for feeding third blanks (e.g., light-transmitting blanks of cellophane or the like) to the fourth receptacles, a third endless conveyor (e.g., an endless chain conveyor similar or identical to the first or second conveyor) having fifth receptacles and means for moving the fifth receptacles along an endless seventh path having a portion adjacent a second portion of the sixth path, and means for expelling commodities and blanks from the fourth receptacles into the fifth receptacles.

The machine can further comprise a series of second pockets for discrete commodities, second transporting means for transporting the second pockets in a second predetermined direction along a second first path, a second pouch provided on the second transporting means in substantial parallelism with the front side of each second pocket, and means for supplying blanks into the second pouches along another second path. The first endless conveyor is then installed in such a way that it includes portions adjacent both first paths, and the pockets of each of the two series are provided with pushers or other suitable means for expelling commodities from the respective pockets into the (first) receptacles of the first conveyor.

As stated above, the machine can comprise a series of three endless conveyors (such as chain conveyors) with (first, third and fifth) receptacles for blanks and commodities, pushers or other suitable means for expelling commodities from the pockets into the first receptacles, first rotary conveyor means for transferring commodities and blanks from the first receptacles into the third receptacles (of the second conveyor), and second rotary conveyor means for transferring commodities and blanks from the third receptacles into the fifth receptacles (of the third conveyor). Such machine can further comprise the forementioned means for feeding third (additional) blanks to the second conveyor means for transfer to the fifth receptacles, and a rotary turret or other suitable means for folding blanks on the third conveyor means.

Each series of pockets can comprise three pockets, and the transporting means for each series of pockets can comprise a discrete transporting element for each pocket of the corresponding series and for the respective pouch, and drive means for rotating the transporting elements about a common axis including a discrete shaft for each transporting element. One of the three shafts surrounds another of these shafts, and the third shaft surrounds the other shaft. The drive means or rotating means can further comprise a lever for each shaft, mating teeth provided on the shafts and on the respective levers, a pinion-driven gear or other suitable means for orbiting the levers about the common axis of the shafts, and cam and follower means for pivoting the levers relative to each other during orbital movement above the common axis of the shafts.

The novel features which are considered as characteristic of the invention are set forth in particular in the appended claims. The improved packing machine itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
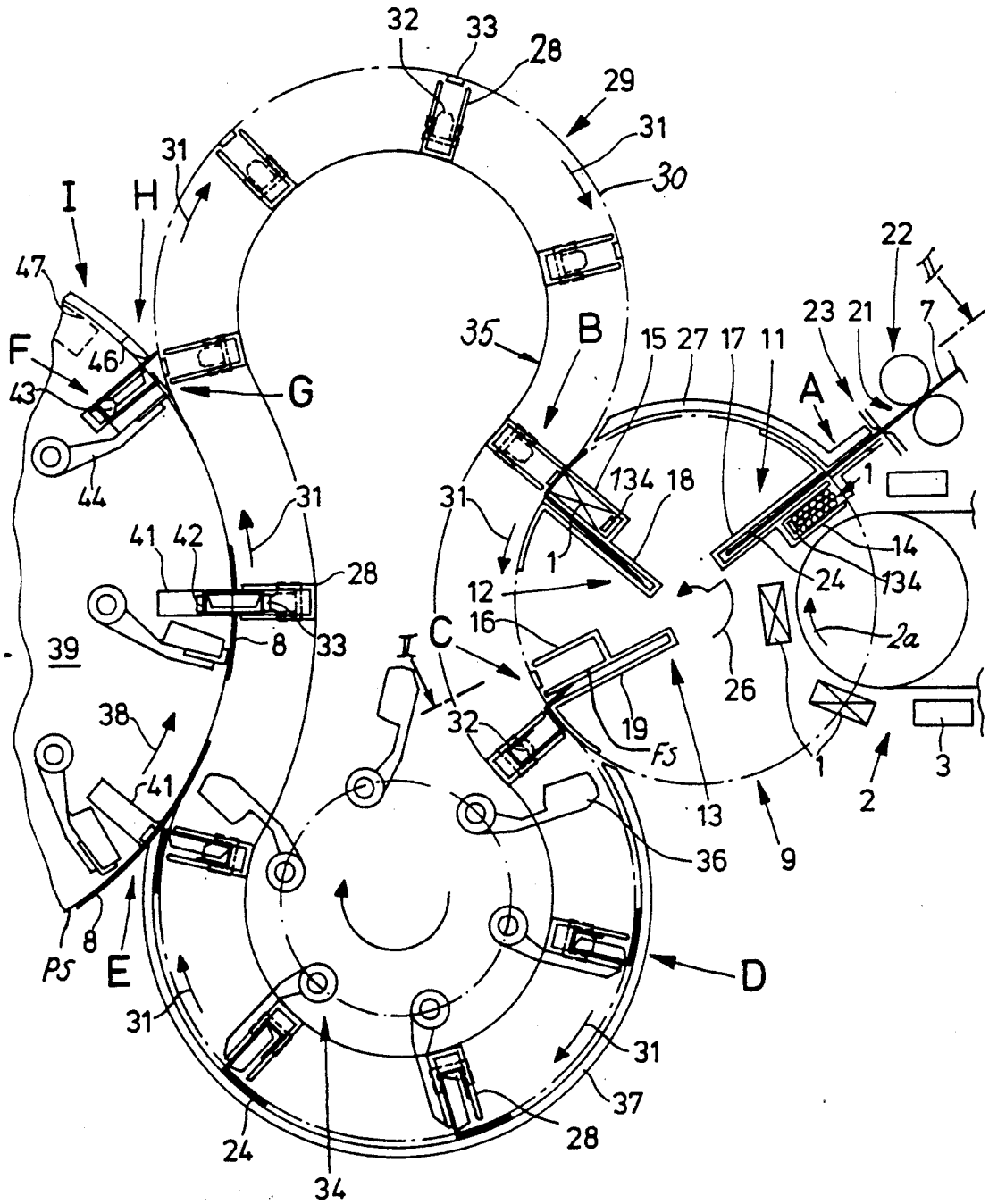
FIG. 1 is a schematic elevational view of a portion of a packing machine which embodies one form of the invention.
Figure 2:
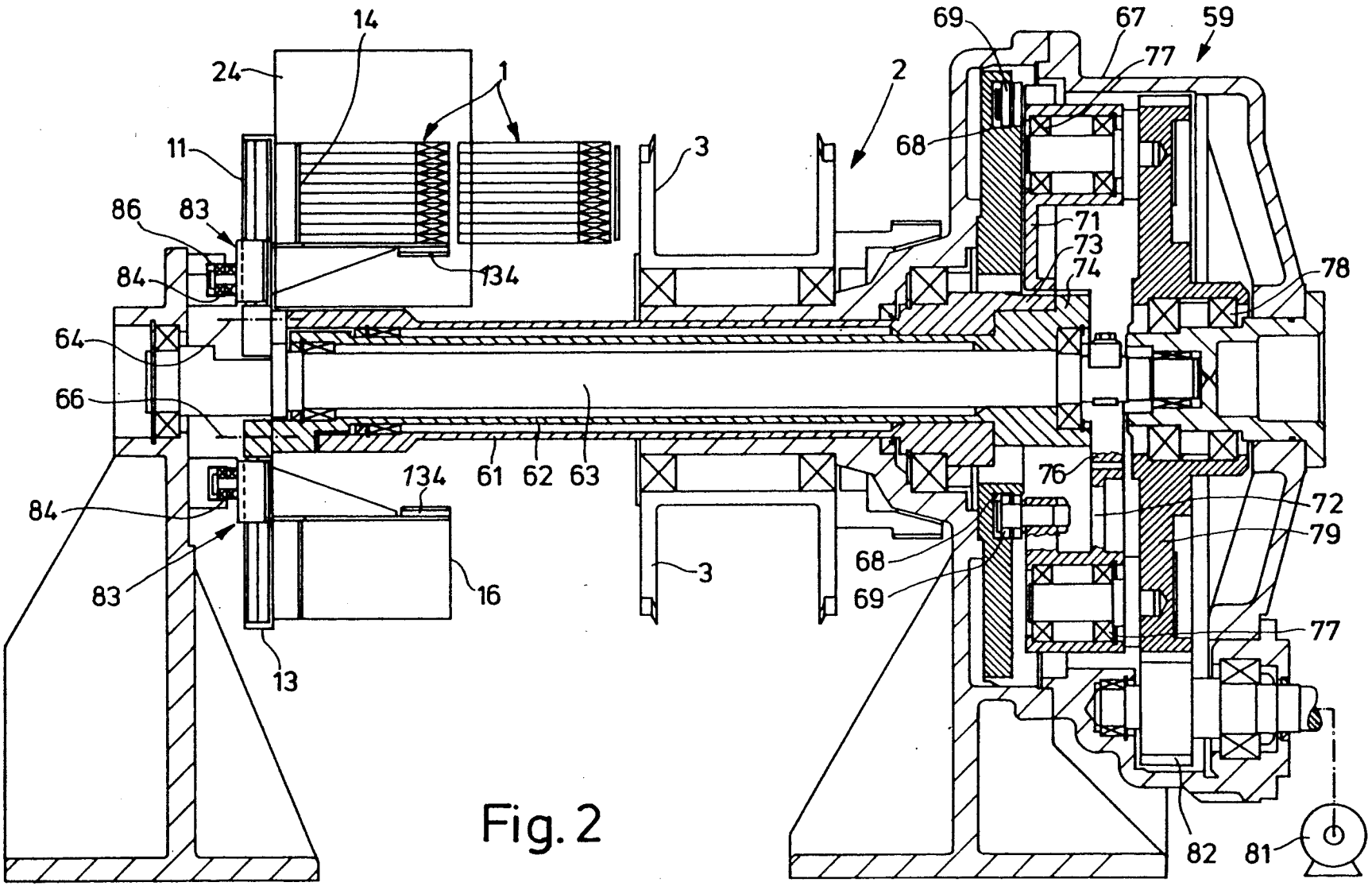
FIG. 2 is an enlarged sectional view substantially as seen in the direction of arrows from the line II—II of FIG. 1.
Figure 3:
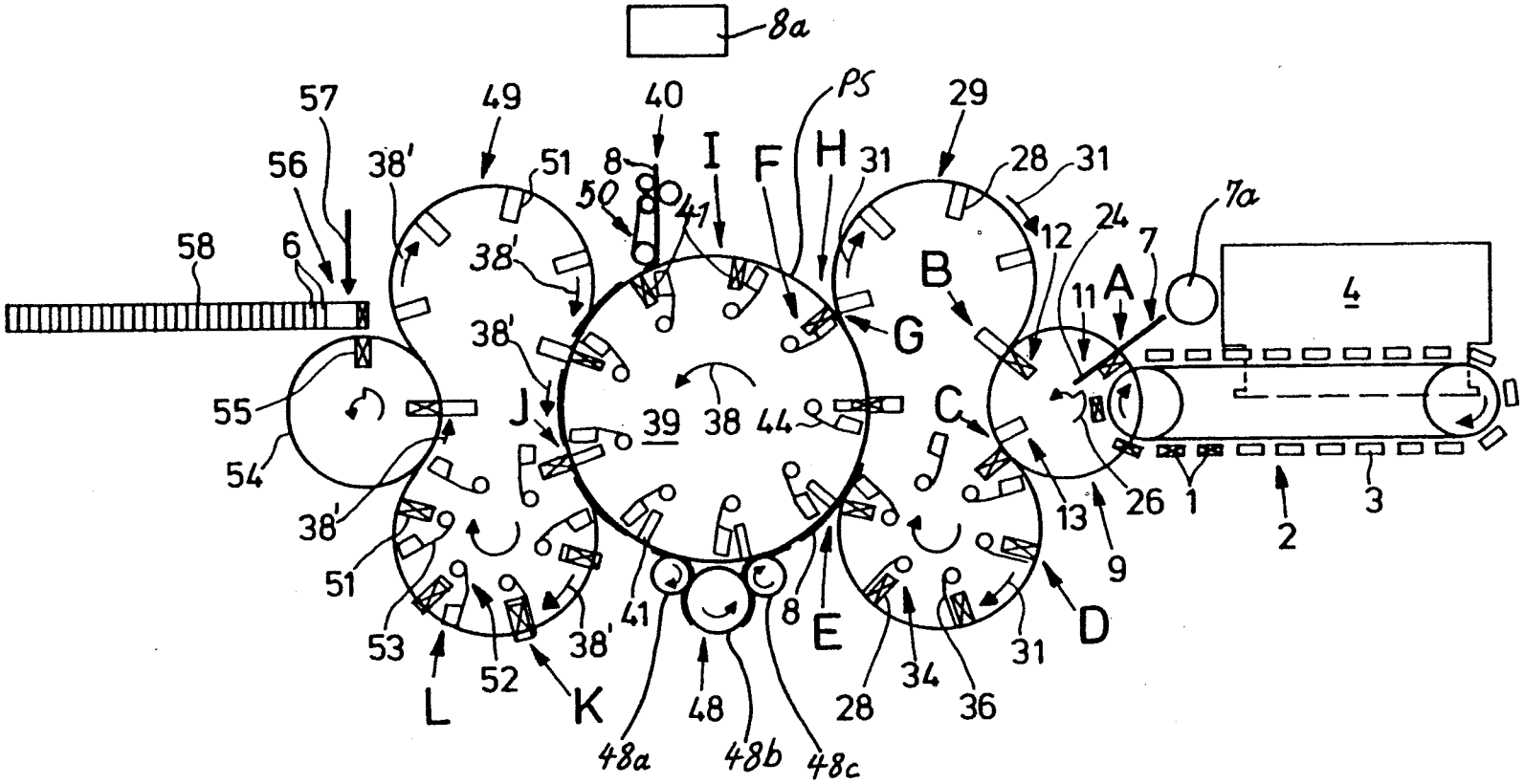
FIG. 3 is a smaller-scale elevational view of the packing machine which embodies the structure of FIGS. 1 and 2.

FIGS. 1 to 3 show certain details of a first packing machine which serves to convert block-shaped commodities 1 and pairs of foldable blanks 8, 24 into soft cigarette packs 6. As can be seen in FIG. *7a*, each commodity 1 (hereinafter called block for short) is an array of twenty parallel filter cigarettes 101 in quincunx formation including two outer layers of seven cigarettes each and a median layer of six cigarettes. The cigarettes of the median layer are staggered with reference to the cigarettes of the outer layers. Each block 1 has two major surfaces or sides I, II, two narrow surfaces or sides III, IV which alternate with the major surfaces, a top end V, and a bottom end VI.

As can be seen in FIGS. 1 and 2, the blocks 1 are delivered by the cells 3 of an endless chain conveyor 2 which is driven in stepwise fashion to advance its cells 3 in the direction of arrow *2a*. The cells 3 receive arrays of filter cigarettes 101 during stepwise advancement beneath a magazine 4 in a manner as disclosed, for example, in commonly owned U.S. Pat. Nos. 4,471,866 (granted Sept. 18, 1984 to Erdmann et al.), 4,503,967 (granted Mar. 12, 1985 to Erdmann et al.) or 4,362,235 (granted Dec. 7, 1982 to Erdmann). The disclosures of these patents are incorporated herein by reference. The blanks 24 are made of metallic foil 7 (such as aluminum foil or tin foil) which is drawn from a source *7a* by two intermittently driven advancing rolls 21 serving to supply metallic foil material into a predetermined portion (at a station A) of an endless first path defined by a specially designed transporting unit 9. The blanks 8 are made of non-metallic material (such as paper, lightweight cardboard, plastic foil or the like) and are supplied from a second source *8a* in the form of a magazine or the like. The blanks 24 are converted into inner envelopes which directly surround the cigarettes 101 of the respective blocks 1, and the blanks 8 are converted into outer envelopes which surround the respective inner envelopes. Conversion of a series of blocks 1, blanks 24 and blanks 8 into a succession of soft packs 6 is carried out during transport of such components along a composite path which is defined by the transporting unit 9 (for the blocks 1 and blanks 24), by a first endless conveyor 29 (for the blocks 1 and blanks 24), by first endless rotary conveyor means 39 (for the blocks 1 and blanks 24, 8), by a second endless conveyor 49 (for the blocks 1 and blanks 24, 8), and by second rotary conveyor means 54 (for soft packs 6). The conveyor 29 can be said to constitute a means for transferring blocks 1 and blanks 24 from the transporting unit 9 to the rotary conveyor means 39, the conveyor means 39 can be said to constitute a means for transferring blocks 1 and blanks 24, 8 from the conveyor 29 to the conveyor 49, and the conveyor 49 is a means for transferring blocks 1 and blanks 24, 8 from the conveyor means 39 to the conveyor means 54.

The transporting unit 9 comprises three similar or identical transporting elements in the form of radially extending arms 11, 12, 13 which respectively carry discrete pockets 14, 15, 16 serving to receive blocks 1 from cells 3 and to advance such blocks stepwise and at a varying speed along certain portions of an endless first path in the direction of arrow 26. Each of the pockets 14, 15, 16 is open at its radially outer side to permit transfer of a block 1 into the adjacent pocket-like (first) receptacle 28 of the conveyor 29 in a (second) portion of the first path (station B in FIG. 1), and at its rear side (as seen in FIG. 1 or 3) to permit transfer of a block 1 from the adjacent cell 3 of the chain conveyor 2.

The front side FS (as seen in the direction of arrow 26) of each of the pockets 14, 15, 16 is adjacent a discrete receptacle (hereinafter called pouch to distinguish from pockets and receptacles) 17, 18, 19, respectively, which is mounted on or forms part of the respective arm 11, 12, 13 and defines a narrow flat compartment for a blank 24. Each of the pouches 17–19 is open at its radially outermost end so that it can receive a length of metallic foil 7 while the respective arm 11, 12 or 13 is at a standstill. At such time, the foil-receiving pouch is in register with the nip 21 of the advancing rolls 22 in the predetermined portion (station A) of the first path. When the pouch at the station A has received a required length of foil 7, a cutting device 23 is actuated to sever a blank 24 from the leader of the foil 7 before the respective arm 11, 12 or 13 is set in motion to transport the freshly formed blank 24 in the direction of arrow 26. The transporting unit 9 is constructed in such a way that, when the pouch 17, 18 or 19 is held at the station A, the corresponding pocket 14, 15 or 16 is held in a (first) portion of the first path in which its open rear side registers with the open front side of a filled cell 3. A pusher (not shown) is then actuated to transfer a block 1 from the cell 3 into the registering pocket 14, 15 or 16 before the conveyor 2 is advances its cells 3 in the direction of arrow *2a* and before the unit 9 transports the respective arm 11, 12 or 13 from the position corresponding to that of the arm 11 toward the position corresponding to that of the arm 12 in FIG. 1.

The manner in which the cutting device 23 is actuated to sever the foil 7 at required intervals in order to form a succession of blanks 24 forms no part of the invention. For example, the cutting device 23 can receive signals from a detector which is activated when the leading edge of the foil 7 reaches the radially innermost end of the compartment of the pouch 17, 18 or 19 at the station A, or the detector can monitor the extent of angular movement of one of the advancing rolls 22 or the extent of angular displacement of the reel in the source of supply *7a* of aluminum foil 7.

The transporting unit 9 is designed to accelerate successive arms 11, 12, 13 from zero speed during transport from the station A to the station B so that the speed of the arm which reaches the station B matches or closely approximates the preferably constant (predetermined) speed of receptacles 28 on the conveyor 29. That portion of the first path which extends from the station A to the station B is adjacent a stationary arcuate folding member 27 which serves to fold successive blanks 24 in a manner as shown in FIG. *7b*, i.e., the member 27 performs the first step of converting successive blanks 24 into tubes (FIG. *7f*) by folding successive blanks 24 against the narrow surfaces IV of the respective blocks 1.

When the arm 11, 12 or 13 reaches the station B, it is transported at the speed of the conveyor 29 at least during a certain stage of advancement from the station B to the station C, and such arm is thereupon decelerated back to zero speed during transport from the station C to the station A. The path which is defined by the conveyor 29 has a concave section which overlies the adjacent section of the first path (for the arms 11–13) between the stations B and C. The direction of advancement of preferably equidistant receptacles 28 along the second path (defined by the conveyor 29) is indicated by arrows 31. This conveyor preferably comprises an endless chain 30 which is installed in such a way that it moves its receptacles 29 along an eight-shaped path. This is achieved by the provision of sprocket wheels (one shown in FIG. 1, as at 35) and by proper positioning of the transporting unit 9 and conveyor means 39. The construction of the conveyor 29 can be similar to or identical with that of conveyors which are disclosed in commonly owned copending patent application Ser. No. 207,294 filed June 15, 1988 by Reinhard Deutsch for "Method of and apparatus for packing rod-shaped articles of the tobacco processing industry", now U.S. Pat. No. 4,866,912 granted Sept. 19, 1989, or in commonly owned copending patent application Ser. No. 216,322 filed July 7, 1988 by Reinhard Deutsch for "Apparatus for transferring block-shaped groups of rod-shaped articles of the tobacco processing industry". Each receptacle 28 registers with one of the pockets 14, 15, 16 during transport of pockets from the station B toward the station C to ensure predictable and convenient transfer of blocks 1 from their pockets into the registering receptacles 28 by expelling devices in the form of pushers 134 which are reciprocably installed in the pockets so that they can move from the radially innermost portions toward the open outer sides of the respective pockets not earlier than at the station B and not later than when a receptacle 28 moving along the path which is defined by the conveyor 29 begins to move ahead of the adjacent pocket 14, 15 or 16.

The conveyor 29 carries a set of folding members 32 which are adjacent the receptacles 28 and serve to provide the blanks 24 with narrow flaps 64F (FIG. *7c*) during transfer of blanks 24 from their pouches into the adjacent receptacles 28. The members 32 fold those projecting portions of the blanks 24 which extend beyond the head ends V of the respective blocks 1, and the flaps 64F are adjacent the narrow surfaces IV of such blocks.

The conveyor 28 carries a discrete expelling member or pusher 33 for each receptacle 28. The pushers 33 are reciprocable between the deepmost portions and the open outer ends of the respective receptacles 28 and serve to transfer blocks 1 and the (partially folded) respective blanks 24 into the (second) receptacles 41 of the conveyor means 39.

The lower loop (as seen in FIG. 1 or 3) of the conveyor 29 surrounds the major part of a rotary folding device 34 which is driven in a clockwise direction at the exact speed of the conveyor 29 and carries a set of pivotable folding members 36. These folding members 36 are active at a station D to provide successive blanks 24 with wide flaps 66F (FIG. *7d*) at the bottom ends VI of the respective blocks 1 and adjacent the major surfaces II of such blocks.

The conveyor 29 advances its receptacles 28 along the concave side of a stationary folding member 37 which extends from the station C to a station E and serves to carry out a further step in conversion of successive blanks 24 into tubes by folding the blanks against the narrow surfaces III of the respective blocks 1 (see FIG. *7c*).

A second concave section of the conveyor 29 overlies an adjacent portion of the conveyor means 39 between the station E and a further station F. This second concave section is substantially a mirror image of the first concave section between the stations B and C; the difference is that the diameter of the rotary transporting unit 9 which is shown in FIGS. 1 to 3 is smaller than the diameter of the conveyor means 39. The latter is driven in synchronism with the conveyor 29 and has the aforementioned radially extending (second) receptacles 41, reciprocable expelling devices or pushers 42 in the receptacles 41, and pairs of folding members 43 adjacent the ends of the receptacles 41 (namely, at the two axial ends of the conveyor means 39). The folding members 43 are movable with reference to the respective receptacles 41 and are put to use at the station F to provide the blanks 24 and 8 with pairs of narrow flaps 67F, 68F

Figure 7A:
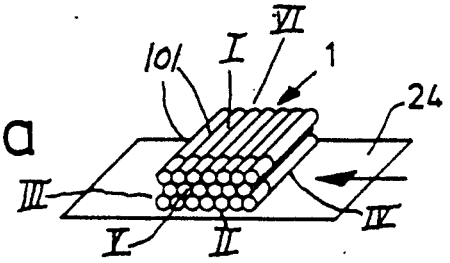
Figure 7B:
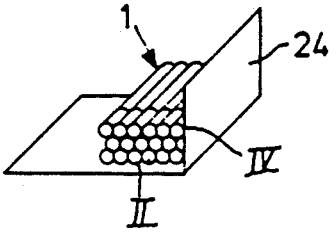
Figure 7C:
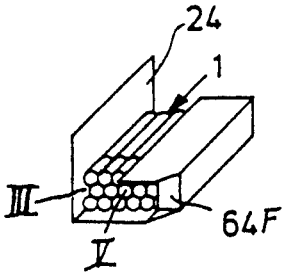
Figure 7D:
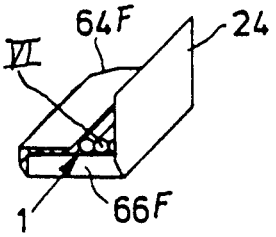
Figure 7E:
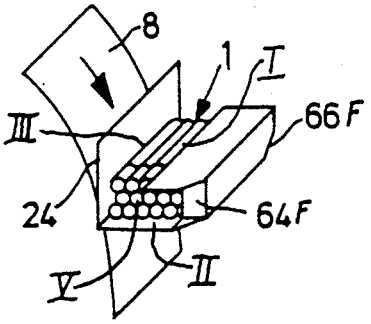
Figure 7F:
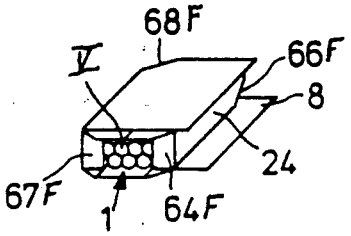

(FIG. 7*f*). The conveyor means 39 further carries pivotable folding members 44 which are put to use at a station G adjacent the station F to provide the blanks 24 and 8 with wide flaps 69F (FIG. 7*g*) at the top ends V of the respective blocks 1. A stationary arcuate folding member 46 is adjacent the peripheral surface of the conveyor means 39 between a station H (adjacent the stations F and G) and a further station I to complete the conversion of blanks 8 into tubes (see FIG. 7*h*).

Figure 7G:
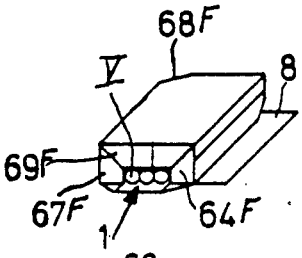
Figure 7H:
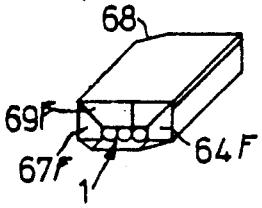
Figure 7I:
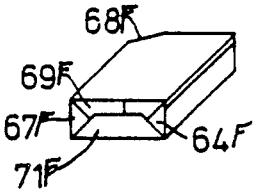

FIG. 1 shows a stationary folding member 47 behind the rear axial end of the conveyor means 39; this folding member serves to provide successive pairs of blanks 24, 8 with wide flaps 71F (FIG. 7*i*).

The means 50 for feeding blanks 8 from the magazine 8*a* to the peripheral surface PS of the conveyor means 39 comprises one or more endless belts 50 and/or rollers which are driven to advance successive blanks 8 substantially radially toward the axis of the conveyor means 39 at the twelve o'clock position, and the peripheral surface PS is provided with suction ports (not specifically shown to attract the blanks 8 in such a way that each blank initially overlies the peripheral surface PS between two neighboring (second)receptacles 41. The means (48) for removing successive blanks 8 from and for immediately returning removed blanks 8 onto the peripheral surface PS of the conveyor means 39 comprises a first roller 48*a* which peels successive blanks 8 off the peripheral surface PS (particularly by suction) and is driven in a clockwise direction (as seen in FIG. 3), a second roller 48*b* which is driven in a counterclockwise direction and accepts successive blanks 8 from the roller 48*a*, and a third roller 48*c* which accepts successive blanks 8 from the roller 48*b* and returns such blanks to the peripheral surface PS but in such a way that the central or median portion of each returned blank 8 overlies the open radially outer end of the respective empty (second) receptacle 41. In other words, the combined removing and returning means 48 serves to lengthen the path of successive blanks 8 on their way from the feeding means 40 to positions of overlap with empty receptacles 41. If desired, the roller 48*c* can receive blanks 8 from or such roller can constitute a component part of means for feeding blanks 8 to positions of overlap with empty receptacles 41.

The conveyor means 39 is driven in the direction of arrow 38, and the pushers 42 in its receptacles 41 serve to expel blocks 1 and pairs of blanks 24, 8 into the adjacent (third) receptacles 51 of the second endless conveyor 49 which is or can be identical with the (first) conveyor 29. The chain of the conveyor 49 moves the receptacles 51 in the direction of arrows 38' past a series of stations J, K and L prior to expelling finished packs 6 into the receptacles 55 of the second rotary conveyor means 54. The latter is or can be identical with or analogous to the transporting unit 9. The conveyor 49 cooperates with a second rotary folding device 52 which is analogous to the folding device 34 and has pivotable folding members 53 serving to carry out additional folding operations. Each receptacle 51 contains a reciprocable pusher (not specifically shown) corresponding to one of the pushers 33 and serving to expel soft packs 6 from the respective receptacle 51 into the adjacent receptacle 55. The conveyor 49 further carries folding members (not shown) which are analogous to folding members 32 and are provided at that (front) side of the conveyor 49 which faces the observer of FIG. 3. The just discussed (non-illustrated) folding members are put to use at the station J, and the folding members 53 are put to use at the station K.

An additional stationary folding member (not shown) which is analogous to the folding member 47 is adjacent the station L to carry out a further folding operation which completes the conversion of blanks 24, 8 into the inner and outer envelopes of the respective soft packs 6.

The non-illustrated transporting elements or arms of the conveyor means 54 are in motion while their receptacles 55 receive soft packs 6 from the adjacent receptacles 51, and such arms are at a standstill during expulsion of soft packs from their receptacles 55 into a label applying machine 56 which includes means for delivering revenue labels in the direction of arrow 57. The labels are applied across the outer envelopes (converted blanks 8) at the head ends V of the respective blocks 1, and the thus labelled soft packs 6 are thereupon converted into a file on a gathering conveyor 58 for transport to a cellophaning machine which provides each soft pack with a further (third) envelope of light-transmitting material in a manner which is customary in connection with the making of cigarette packs. Each third envelope is preferably provided with a conventional tear strip which facilitates removal of a portion of the third envelope in the region of the head end V of the corresponding block 1.

The means for driving the arms 11 to 13 of the transporting unit 9 in the aforedescribed manner (so that the arms are accelerated between the stations A and B, that the arms are driven at the speed of the first conveyor 29 from the station B toward the station C, and that the arms are decelerated back to zero speed not later than when they return to the station A) includes a so-called circulating transmission 59 which is shown in FIG. 2. This Figure further shows a portion of the chain conveyor 2 and two of its cells 3. A similar transmission can be used in the second conveyor means 54 except that the transmission of the conveyor means 54 is designed to intermittently drive only two arms (the illustrated conveyor means 54 has only two receptacles or pockets 55).

The transmission 59 of FIG. 2 comprises three coaxial shafts including a hollow outermost shaft 61 for the arm 11, a hollow second shaft 62 which is received in the shaft 61 and carries the arm 12, and an innermost shaft 63 which is received in the shaft 62 and carries the arm 13. The arm 12 cannot be seen in the view of FIG. 2. The shafts 61 to 63 are separably connected with the respective arms 11 to 13 by bolts and nuts 64, 66 (indicated by phantom lines) or by other suitable fastener means.

A gear case 67 of the transmission 59 confines a stationary cam 68 having in one of its end faces an endless cam groove for roller followers 69. Such roller followers are provided on a first lever 71 which is connected with the arm 11, on a second lever (not shown in FIG. 2) which is connected with the arm 12, and a third lever 72 which is connected with the arm 13. The lever 71, the lever for the arm 12 and the lever 72 extend radially inwardly toward the common axis of the shafts 61 to 63 and their radially innermost portions are provided with gear teeth in mesh with gears (e.g., gear segments) 73, 74, 76 on the respective shafts 61, 62 and 63. The levers are further rotatable on bearings 77 which are carried by a gear 79. The latter is coaxial with the shafts 61–63 and is rotatable on bearings 78. Its teeth are in mesh with the teeth of a pinion 82 which is driven by an electric motor 81 or by another suitable prime mover.

The aforediscussed movements of the arms 11 to 13 relative to each other including acceleration, movement at the speed of the conveyor 29 and deceleration are imparted by the rotated gear 79 which orbits the three levers and by the roller followers 69 which track the surfaces bounding the groove of the stationary cam 68 in the gear case 67. The gear segments 73, 74 and 76 transmit the superimposed orbital and pivotal movements of the levers (including the levers 71, 72) to the shafts 61 to 63 for the respective arms 11 to 13.

The means for moving the pushers 134 in the pockets 14 to 16 of the respective arms 11 to 13 is shown in the left-hand portion of FIG. 2. The pushers 134 have radially disposed extensions which are reciprocable in radially extending guides 83 of the respective arms 11 to 13. The extensions of the pushers 134 carry roller followers 84 which extend into the endless groove of a stationary cam 86 on the frame for the end portions of the shafts 61-63 and for the gear case 67 of the transmission 59. Each orbital movement of a pusher 134 about the common axis of the shafts 61 to 63 involves a radially outward movement of the respective pusher 134 at the station B or between the stations B and C, and a radially inward movement of the pusher 134; such inward movement is completed not later than when the respective pocket 14, 15 or 16 reaches that (first) portion of its path where such pocket registers with a filled cell 3 of the chain conveyor 2 to be ready for reception of a block 1.

The mode of operation of the packing machine of FIGS. 1 to 3 is as follows:

The chain conveyor 2 is driven (arrow *2a*) in stepwise fashion so that it comes to a halt whenever the foremost filled cell 3 registers with an empty pocket (14, 15 or 16) in the first portion of the endless path which is defined by the transporting unit 9. In FIG. 1, the pocket 14 on the arm 11 is at a standstill and registers with the foremost filled cell 3 of the conveyor 2 (which is then at a standstill). A pusher (not shown) is then actuated to expel the block 1 from the cell 3 into the pocket 14 before the arm 11 is set in motion in the direction of arrow 26. The open radially outermost portion of the flat compartment in the pouch 17 on the arm 11 registers with the nip 21 of the advancing rolls 22 which are driven to advance the foil 7 into the pouch 17. Such introduction of the leader of the foil 7 can take place simultaneously with the transfer of a block 1 from a cell 3 into the pocket 14. The cutting device 23 is actuated when the length of the leader of the foil 7 radially inwardly of the severing plane matches the length of a full-sized blank 24. The freshly formed blank 24 in the pouch 17 is adjacent but spaced apart from the block 1 in the pocket 14 because the pouch 17 is adjacent the front side FS of the pocket 14, i.e., the blank 24 in the compartment of the pouch 17 is not in direct contact with the block 1 in the pocket 14 (see also FIG. *7a*).

The transmission 59 then sets the arm 11 in motion to accelerate the pocket 14 and the pouch 17 to the speed of the conveyor 29 not later than at the station B or not later than at that portion of the first path where the respective pusher 134 is moved by the cam 86 to expel the block 1 from the pocket 14 and to introduce the expelled block into the registering receptacle 28. On its way from the station A toward the station B, that portion of the blank 24 in the pouch 17 which projects beyond the radially outermost portion of its compartment is folded by the stationary folding member 27 (see FIG. *7b*) so that the blank 24 is converted into an L-shaped body which overlies the major surface II and the narrow surface IV of the respective block 1. Consequently, when the block 1 is expelled from its pocket (see the pocket 15 at the station B of FIG. 1) into the adjacent registering receptacle 28, the blank 24 is folded by the block in cooperation with the conveyor 29 so that it overlies a portion of the major surface I of the block in the receptacle 28 (this is shown in the right-hand portion of FIG. *7c*).

The transmission 59 then drives the arm which has reached the station B (note the arm 12 in FIG. 1) at the speed of the conveyor 29 at least until the transfer of the block 1 and of the partially tubular blank 24 into the registering receptacle 28 is completed (see the pocket 16 which is located at the station C and is empty). Such transfer of the block 1 also results in transfer of the respective blank 24 with attendant folding of the blank 24 so that it more closely resembles a tube.

The folding member 32 at the receptacle 28 which is in the process of receiving a block 1 and a blank 24 provides the blank 24 with the narrow flap 64F (FIG. *7c*) which is adjacent the narrow surface IV at the top end V of the respective block 1. Deceleration of the pocket (note the pocket 16 in FIG. 1) which has been relieved of its block 1 can begin at the station C or even before, namely as soon as the block 1 is fully received in the corresponding receptacle 28, and such pocket is then decelerated (either gradually or stepwise) to reach the zero speed in the first portion of its path (when it comes to a position of register with the foremost filled cell 3 of the chain conveyor 2).

The receptacle 28 which has received a block 1 and the corresponding blank 24 at the station B, or between the stations B and C, continues to advance at a constant speed in the direction of arrows 31 whereby the conveyor 29 extracts the outwardly projecting portion of the blank 24 from the compartment of the respective pouch (note the pouch 19 in FIG. 1), and such projecting portion then advances beneath the stationary folding member 37 which folds the blank 24 along the narrow surface III of the respective block 1 (see the left-hand portion of FIG. *7c*).

One of the pivotable folding members 36 on the rotary folding device 34 is pivoted relative to the folding device at the station D to provide the blank 24 in the adjacent receptacle 28 with a wide flap 66F (FIG. *7d*) at the bottom end VI and adjacent the major surface II of the respective block 1.

The block 1 is then advanced to the station E with one marginal portion of the respective blank 24 still extending beyond the major surface I in a manner as shown in FIGS. *7c* and *7d*. It is to be noted that, in FIG. *7d*, the block 1 and the associated blank 24 are turned through 180° with reference to their positions of FIG. *7c*. The feeding means 40 supplies discrete second blanks 8 which are applied by the combined removing and returning means 48 in a manner as shown in FIG. *7e*, i.e., in such a way that the inner side of the applied blank 8 overlies the still unfolded portion of the associated blank 24. In other words, the conversion of blank 24 into a tube (shown in FIG. *7f*) is completed subsequent to delivery of the corresponding blank 8. As explained above, each second blank 8 is first placed against the peripheral surface PS of the conveyor means 39 between two neighboring receptacles 41, and the rollers 48a to 48c thereupon cooperate to shift such blank so that it median portion overlies the respective empty receptacle 41 in a manner as shown in FIG. 1 (at the station E) and in FIG. 7*e*.

One of the pushers 33 is actuated to expel the block 1 and the respective blank 24 from the corresponding receptacle 28 of the conveyor 29 and to transfer such block and blank into the aligned receptacle 41. This completes the conversion of blank 24 into a tube and simultaneously entails conversion of the blank 8 into a U-shaped body (see FIG. 7*f* which shows a block 1, a blank 24 and a blank 8 in two different positions at 180° relative to each other).

The pairs of movable folding members 43 are actuated at the station F to provide the blanks 24 and 8 with narrow flaps 67F, 68F, the former at the head end V and the latter at the bottom end VI of the respective block. In other words, at least one of the flaps 67F, 68F is formed by folding the inner blank 24 jointly with the outer blank 8.

The next folding steps are carried out at the station G where one of the pivotable folding members 44 on the conveyor means 39 is caused to form the wide flap 69F which is shown in FIGS. 7*g* and 7*h*. Moreover, the stationary folding member 46 acts upon the outer blank 8 to fold it over a portion of the narrow surface IV in a manner as shown in FIG. 7*h* and to thus complete conversion of the outer blank 8 into a tube.

The block 1 and its blanks 24, 8 then advance along the stationary folding member 47 behind the conveyor means 39 so that the top end V of the block 1 is sealed because the blanks 24 and 8 are jointly formed with a wide flap 71 (FIG. 7*i*). Sealing of the top end V of the block 1 is completed at or in the region of the station I.

Figure 7J:
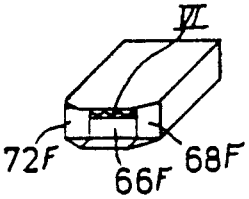

The block 1 thereupon reaches that portion of the (fourth) path defined by the conveyor means 39 where the receptacles 41 move in alignment with adjacent receptacles 51 of the second conveyor 49. The pusher 42 in the receptacle 41 containing a block 1 which is ready for expulsion transfers such block into the adjacent registering receptacle 51 and the aforementioned non-illustrated folding member (corresponding to one of the folding members 32 on the first conveyor 29) then provides the blanks 24, 8 with a common narrow flap 72F (FIG. 7*j*) at the bottom end VI of the respective block 1. This takes place at the station J.

Figure 7K:
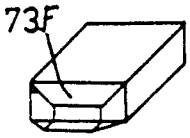
Figure 7L:
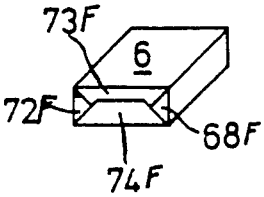
Figure 7L:
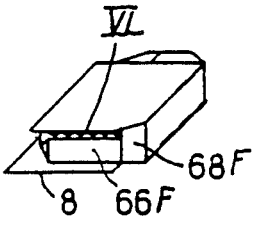

One of the folding members 53 on the rotor 52 is pivoted to operative position at the station K to provide the blanks 24, 8 with a common wide flap 73F (FIG. 7*k*) at the station K, and the non-illustrated stationary folding member at the station L then provides the blanks 24, 8 with a common wide flap 74F (FIG. 7*l*) to thus complete the folding of the two blanks at the bottom end VI of the respective block 1, i.e., to complete conversion of a block 1 and two blanks 24, 6 into a soft pack 6.

The thus produced soft packs 6 are transported by the conveyor 49 toward the transfer station between this conveyor and the conveyor means 54. One of the two pockets or receptacles 55 registers with the adjacent filled receptacle 51 at the three o'clock position of the conveyor means 54, and the arm which carries such receptacle or pocket 55 then moves at the exact speed of the conveyor 49. The respective arm of the conveyor means 54 is decelerated to zero speed when it reaches the label applying machine 56 where the pack 6 is provided with a revenue label arriving in the direction of arrow 57. The thus labelled pack 6 is caused to form the last pack of the file of neighboring packs on the gathering conveyor 58 which delivers soft packs into a cellophaning machine.

An advantage of the transporting unit 9 is that the foil 7 can be moved relative to the adjacent block 1 without any interference on the part of the block. This is due to the fact that the compartment of each of the pouches 17–19 is spaced apart from the interior of the adjacent pocket 14, 15, 16, respectively. A blank 24 begins to move jointly with the adjacent block 1, and the block comes in actual contact with the blank 24, only when the position of the blank with reference to the block is sufficiently fixed to ensure the making of an inner envelope having a predictable size and shape and closely following the four surfaces and the two ends of the respective blocks.

It will be noted that partial conversion of a metallic blank 24 into a tube takes place while the respective block 1 is being shifted transversely of a portion of the path for the chain conveyor 30 wherein the conveyor 30 moves its receptacles 29 in a counterclockwise direction (between the stations B and C), and that a further stage of conversion of the blank 24 into a tube (simultaneously with partial conversion of the corresponding blank 8 into a tube) takes place while the respective block 1 is being shifted transversely of a portion of the path for the receptacles 29 wherein such receptacles are again moved in a counterclockwise direction (between the stations E and F), namely during transfer of the respective block from a receptacle 29 into the registering receptacle 41. The shifting of blocks 1 takes place substantially radially of those sections of the conveyor 29 which are adjacent the first path (defined by the transporting unit 9) and the fourth path (defined by the conveyor means 39). The (third) path which is defined by the conveyor 29 includes sections where the receptacles 29 are moved in a clockwise direction (around the sprocket wheel 35 and around the rotary folding device 34), and sections where the receptacles 29 are moved in a counter-clockwise direction (between the stations B–C and F—F). This contributes to a reduction of space requirements of the conveyor 29 and of the entire packing machine, especially since the conveyor 49 is or can be identical with the conveyor 29.

The placing of the feeding means 40 and of the blank removing and returning means 48 adjacent the conveyor means 39 constitutes a novel and highly advantageous feature of the packing maching. These means render it possible to deliver blanks 8 in optimum positions with reference to the corresponding blocks 1 and blanks 24, preferably in such a way that the central portion of each returned blank 8 overlies the open outer end of the respective receptacle 41 before the receptacle receives a block 1 and the associated blank 24. This results in conversion of blanks 8 into U-shaped bodies of the type shown in FIG. 7*f*. It will be noted that a blank 8 which overlies the adjacent empty receptacle 41 is converted into a U-shaped body by the corresponding blank 24 which, at such time, undergoes the last stage of conversion into a tube (FIG. 7*f*).

A further advantage of the feeding means 40 and combined removing and returning means 48 is that the conveyor means 39 performs several functions, namely that of cooperating with the conveyor 29 in carrying out the last stage of conversion of successive blanks 24 into tubes, supporting the blanks 8 on their way toward the combined removing and returning means 48, and cooperating with the blocks 1 in converting properly centered blanks 8 into U-shaped bodies.

Still another advantage of the feeding means 40 and combined removing and returning means 48 is that the locus of delivery of blanks 8 can be selected practically at will, particularly with a view to afford access to the corresponding portions of the conveyor means 39. The dimensions and/or other characteristics of the combined removing and returning means 48 can be readily selected in such a way that the path for the blanks 8 is lengthened to a desired extent, i.e., that any selected portion of a blank 8 can be moved to a position of overlap with the radially outermost end of the respective pocket 41 in the peripheral surface PS of the conveyor means 39.

Conversion of blanks 24, 8 into tubes can be carried out practically without pivotable or otherwise movable folding members. This will be readily seen in FIG. 1 which shows that only the folding members 44 are used to carry out one step in conversion of blanks 8 into envelopes. These folding members serve to convert each U-shaped body (partially converted blank 8 shown in FIG. 7*f*) into a body of the type shown in FIG. 7*g*. The last stage of conversion of successive blanks 8 into tubes (FIG. 7*h*) is carried out by the stationary folding member 47.

Movably mounted folding members for conversion of blanks 24 into tubes are not needed because such conversion takes place in part during transport of blanks 24 along the stationary folding member 27, in part during expulsion of blocks 1 from their pocket 14, 15 or 16 into the registering receptacles 29, during relative movement of receptacles 29 and arms 11, 12, 13 in the region of the station C (this results in automatic extraction of projecting portions of blanks 24 from their pouches and simultaneous partial folding of the blanks), during movement of blanks 24 along the stationary folding member 37, and finally during transfer of blanks 24 from the receptacles 29 into the registering receptacles 41. Deceleration (rather than acceleration) of arms 11, 12, 13 at and downstream of the station C is preferred because this automatically results in folding of the radially outwardly extending portions of blanks 24 in the proper direction (over the narrow surfaces III of the blocks 1) and also because it is presently preferred to transfer blocks 1 from the conveyor 2 onto the transporting unit 9 while the arm 11, 12 or 13 at the station A is at a standstill.

The provision of a single rotary conveyor means (39) in combination with two endless conveyors (29, 49) and two transporting units (9, 54) suffices if the packing machine is to turn out soft packs 6 each of which has two envelopes.

Figure 4:
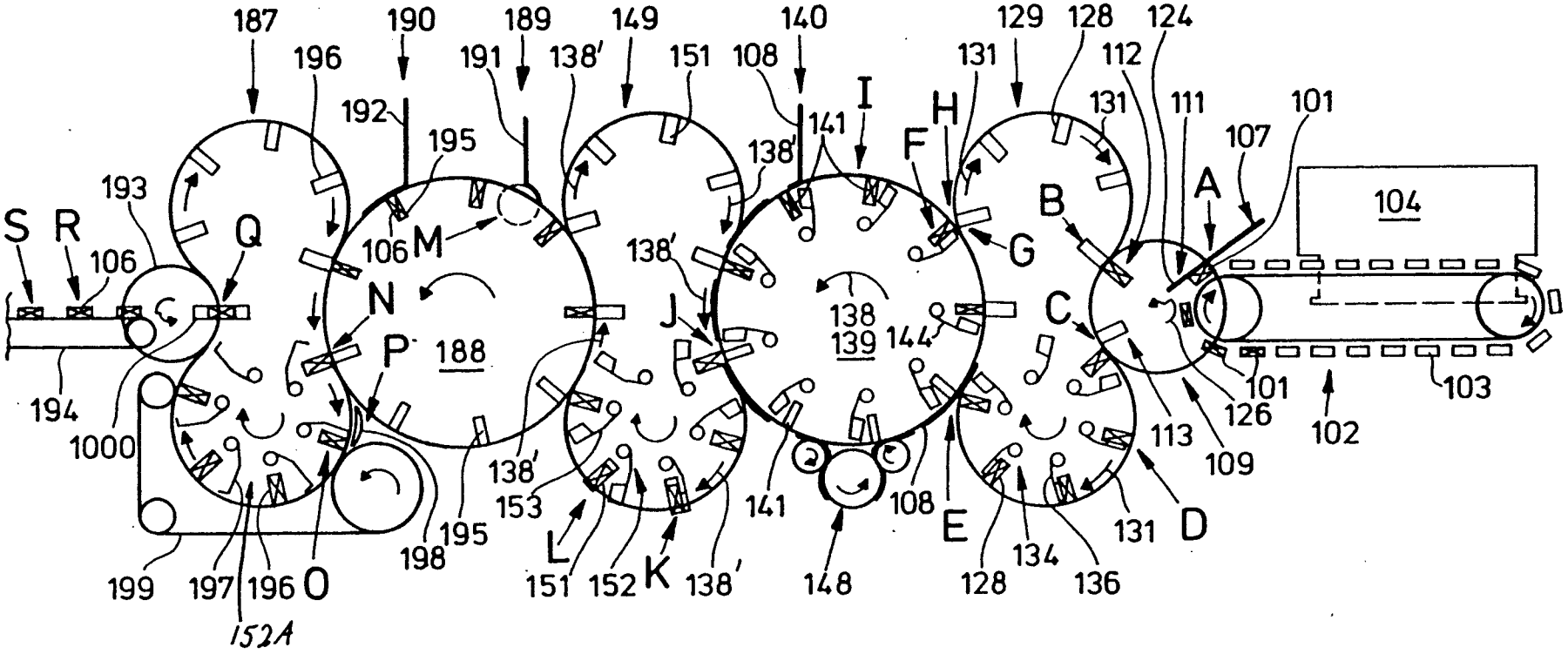
FIG. 4 is a schematic elevational view of a modified packing machine.

FIG. 4 shows a packing machine wherein all such parts which are identical with or clearly analogous to corresponding parts of the machine of FIGS. 1 to 3 are denoted by similar reference characters plus 100. The difference between the two packing machines is that the second conveyor 149 of the machine which is shown in FIG. 4 is followed by a second conveyor means 188 which is identical with or analogous to the first conveyor means 139. The second conveyor means 188 is followed by a third eight-shaped conveyor 187 which precedes (as seen in the direction of transport of blocks 101 and blanks 124, 108) a transporting unit or conveyor means 193 serving to deliver thrice wrapped soft packs 106 onto the upper reach of an endless belt conveyor 194. The first, second and third endless conveyors 129, 149 and 187 are driven at a constant speed (or at least continuously), the same as the conveyor means 139 and 188. Portions of the peripheral surface of the first conveyor means 139 are flanked by arcuate (concave) sections of the conveyors 129, 149, and portions of the second conveyor means 188 are flanked by arcuate (concave) sections of the conveyors 149, 187. The blanks 124 are obtained by severing a continuous metallic foil 107 at the station A in the same way as described with reference to FIGS. 1 to 3, the blanks 108 are fed by the feeding means 140 (denoted by an arrow) to the peripheral surface of the conveyor means 139 in the same way as described in connection with the blanks 8, and a second feeding means 190 is provided to deliver third blanks 192 to the peripheral surface of the second conveyor means 188 in such a way that each third blank 192 overlies a finished soft pack 106 in the adjacent receptacle 195 of the conveyor means 188.

The arrow 189 denotes in FIG. 4 the direction of delivery of revenue labels 191. Thus, the conveyor means 188 constitutes or forms part of a label applying machine which completes its task ahead of the locus of feeding third blanks 192. Each blank 192 can consist of cellophane or other suitable light-transmitting material which is converted into a third envelope surrounding the second envelope which is formed as a result of conversion of one of the second blanks 108.

The operation of the packing machine of FIG. 4 ahead of, at and between the stations A and L is identical with or clearly analogous to that of the packing machine of FIGS. 1 to 3. When a soft pack 106 with two envelopes advances beyond the station L (in the respective (third) receptacle 151 of the second conveyor 149), it is transferred into the registering (fourth) receptacle 195 of the second conveyor means 188 ahead of the locus of delivery (arrow 189) of revenue labels 191. The application of revenue labels 191 to successive soft packs 106 takes place at the station M. The thus labelled soft pack 106 then advances (in the respective receptacle 195) toward the station N and is overlapped by a third blank 192 which is supplied by the feeding means 190 and overlies one of the two narrow surfaces III, IV of the respective block 101. The soft pack 106 and the corresponding third blank 192 are then advanced to the station N where a pusher (not specifically shown) in the respective (fourth) receptacle 195 transfers the soft pack and the associated label 192 into the registering (fifth) receptacle 196 of the third conveyor 187. The blank 192 is provided with a narrow flap at each end of the respective block 101 during or immediately after transfer of the respective pack 106 into the receptacle 196. Pivotable folding members 197 of a rotary folding device corresponding to the folding device 134 act upon successive blanks 192 at the station O, and a stationary folding member 198 acts upon successive blanks 192 at the station P to complete conversion of the blanks 192 into tubes. An endless sealing element 199 is trained over a set of pulleys and acts upon successive blanks 192 downstream of the station P to seal the overlapping portions of each blank 192 to each other.

Each (by then tubular) blank 192 is provided with additional narrow flaps at the top and bottom ends of the respective block 101 at a station Q just prior to or during actual transfer of the respective pack 106 into the adjacent receptacle or pocket 1000 of the transferring unit or conveyor means 193. The manner in which the arms (not specifically shown) which carry the receptacles or pockets 1000 are moved in order to transfer soft packs 106 onto the upper reach of the conveyor 194 is analogous to the manner of moving the arms 11 to 13 of the transporting unit 9. The arms for the receptacles or pockets 1000 of the transporting unit 193 are brought to a standstill during transfer of soft packs 106 (with partially converted light-transmitting blanks 192) onto the conveyor 194. The third blanks 192 of successive soft packs 106 are provided with pairs of wide flaps at the stations R and S (i.e., during travel with the conveyor 194, and the overlapping wide flaps of the blanks 192 are sealed to each other, e.g., at the station S, to complete the conversion of blanks 192 into parallelepiped envelopes which surround the respective second envelopes (converted blanks 108).

An advantage of the packing machine of FIG. 4 is that it can provide each block 101 with more than two envelopes and also that the application of revenue labels 191 can be carried out at the same rate at which the blocks 101 are provided with inner, intermediate and outer envelopes. In other words, the label applying machine and the cellophaning machine are integrated into the packing machine.

The entire machine can be assembled of several modules which are grouped together in dependency on the desired number of envelopes in each pack and/or other requirements. This holds true for each embodiment of the improved packing machine.

Figure 5:
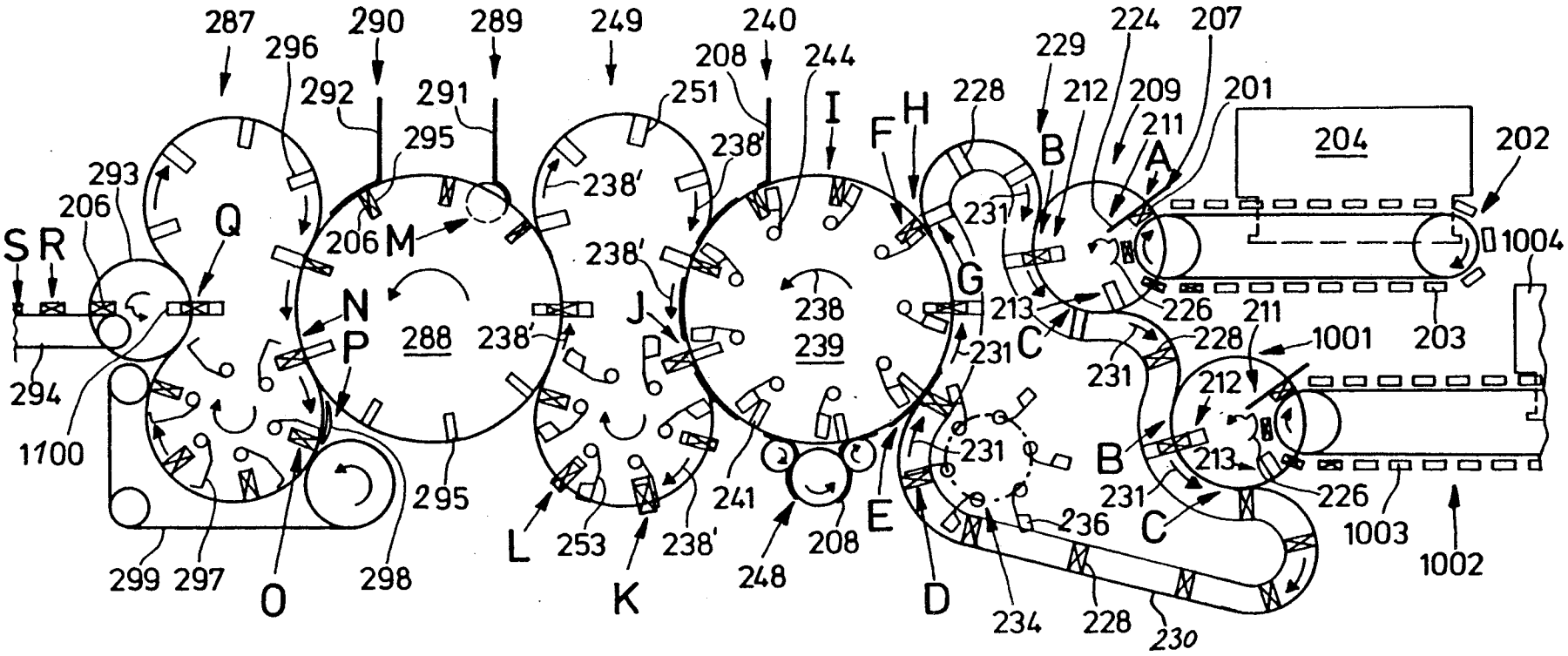
FIG. 5 is a similar schematic elevational view of a third packing machine.

FIG. 5 shows a third packing machine wherein all such parts which are identical with or clearly analogous to corresponding parts of the packing machine of FIG. 4 are denoted by similar reference characters plus 100.

The packing machine of FIG. 5 comprises two magazines 204, 1004 for rod-shaped articles, two endless chain conveyors 202, 1002 which respectively carry series of cells 203, 1003 and receive rod-shaped articles from the magazines 204, 1004, respectively, and two transporting units 209, 1001. Therefore, the endless chain 230 of the first endless conveyor 229 is caused to advance its (first) receptacles 228 along a different path which has two first portions, namely one between the stations B, C associated with the transporting unit 209 and the other between the stations B, C associated with the second transporting unit 1001.

An advantage of the packing machine of FIG. 5 is that it can turn out a large number of soft packs 206 per unit of time. It will be appreciated that the receptacles 228, 251, 296 of the conveyors 229, 249, 287 and the receptacles 241, 295 of the conveyor means 239, 288 are moved faster than the corresponding receptacles (128, 151, 196 and 141, 195) of the packing machine which is shown in FIG. 4.

Figure 6:
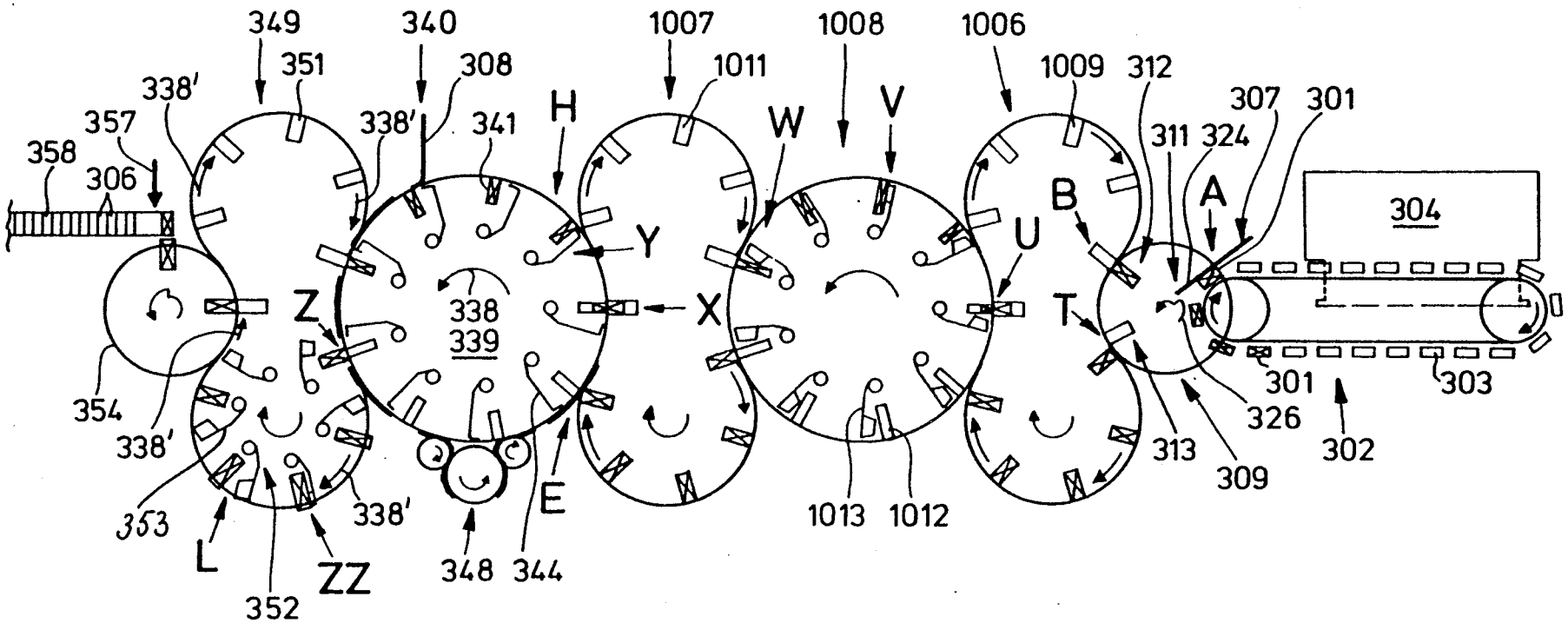
FIG. 6 is a similar schematic elevational view of a fourth packing machine; and FIGS. *7a* to 71 show different stages of conversion of two blanks in the packing machine of FIGS. 1 to 3.

FIG. 6 shows a fourth packing machine wherein all such parts which are identical with or clearly analogous to corresponding parts of the packing machine of FIG. 3 are denoted by similar reference characters plus 300. The packing machine of FIG. 6 comprises three eight-shaped conveyors 1006, 1007, 349. The conveyors 349, 1007 flank a conveyor means 339, and the conveyors 1006, 1007 flank a conveyor means 1008. Feeding means 340 is provided to deliver blanks 308 to the peripheral surface of the conveyor means 339, and the conveyor 349 cooperates with a rotary folding device 352 having pivotable folding members 353. The conveyors 1006, 1007 are respectively provided with equidistant receptacles 1009, 1011 but these conveyors do not cooperate with rotary folding devices (such as the folding device 352). The conveyor means 1008 has radially extending receptacles 1012 and pivotable folding members 1013.

The packing machine of FIG. 6 first provides a metallic blank 324 for each block 301 on the transporting unit 309. The conversion of successive blanks 324 into inner envelopes which surround the respective blocks 301 at both major surfaces, at both narrow surfaces and at both ends is completed ahead of the locus (station E) where the second (e.g., paper) blanks 308 are caused to overlie the receptacles 341 of the conveyor means 339. The conversion of metallic blanks 324 into inner envelopes is as follows:

At a station T (which follows the station B), each blank 324 is provided with two narrow flaps, one at the top end and the other at the bottom end of the respective block 301. Each blank 324 is provided with two additional narrow flaps (one at the top end and the other at the bottom end of the respective block 301) at a station U between the conveyor 1006 and conveyor means 1008. First wide flaps are provided at the top and bottom ends of successive blanks 324 during travel past the station V on the conveyor means 1008, and each blank 324 provided with two additional wide flaps (one at the top end and the other at the bottom end of the respective block 301) during travel at or past the station W between the conveyor means 1008 and the conveyor 1007.

The conversion of blanks 308 into outer envelopes of soft packs 306 is carried out as follows: One narrow flap at the bottom end of the respective block 301 is formed at the station E between the conveyor 1007 and conveyor means 339. Conversion of the blank 308 into a tube is started at the station Y upon completed transfer (at the station X) of such blank and the corresponding block 301 (with converted blank 324 thereon) into the respective receptacle 341 of the conveyor means 339. Conversion of blanks 308 into tubes is completed at the station H. A second narrow flap is formed on each blank 308 (at the bottom end of the respective block 301) at the station Z, and a first wide flap (again at the bottom end of the respective block 301) is formed at the station ZZ. The second wide flap of the blank 308 at the bottom end of each block 301 is formed at the station L.

The machine of FIG. 6 can be modified in a number of ways without departing from the spirit of the invention. For example, this machine can be equipped with means for applying revenue labels (e.g., in the same manner as described in connection with FIG. 5) and with means for applying transparent third blanks (note the blanks 292 of FIG. 5) so that each pack which leaves the second transporting unit 354 already carries a revenue label on its second envelope and is provided with a third envelope around the second envelope. Thus, the structure shown in FIG. 6 downstream of the transporting unit 354 can be omitted.

The packing machine of FIG. 6 employs several modules of the previously described packing machines but is assembled in such a way that the making of first envelopes (converted metallic blanks 324) is completed prior to delivery of second blanks 308 on the conveyor means 339. This shows the flexibility of the improved machine, i.e., its modules can be assembled for the purpose of starting the conversion of a second blank into an envelope before the conversion of the first blank into an envelope is completed, or the conversion of a second blank begins only when the conversion of the corresponding first blank is already completed.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for making packs from sheet-like flexible blanks and block-shaped commodities including arrays of rod-shaped articles of the tobacco processing industry, comprising a series of pockets for discrete commodities; means for delivering commodities only into said pockets means for transporting said pockets in a predetermined direction along a first path, each of said pockets having a side extending substantially transversely of said direction; a pouch provided on said transporting means in substantial parallelism with said side of each of said pockets; and means for supplying blanks only into said pouches along a second path, said pouches defining narrow compartments for discrete blanks and each of said pouches being adjacent said side of a different one of said pockets.

2. The machine of claim 1, wherein said sides of said pockets face in said predetermined direction.

3. The machine of claim 1, wherein said second path crosses a predetermined portion of said first path, said supplying means being adjacent said predetermined portion of said first path so that a pouch which enters said predetermined portion is aligned with and is ready to receive a blank from said supplying means.

4. The machine of claim 1, for making packs from blanks having portions which project from the respective pouches, further comprising folding means adjacent said first path downstream of said supplying means and operative to fold projecting portions of blanks in said pouches.

5. The machine of claim 1, wherein said delivering means comprises means for delivering commodities into successive pockets in a first portion of said first path and further comprises means for expelling commodities from successive pockets in a second portion of said first path, said expelling means comprising discrete pushers in said pockets and means for moving said pushers with reference to the respective pockets.

6. The machine of claim 5, wherein said transporting means includes means for arresting successive pockets in the first portion of said first path and for continuously advancing successive pockets along said second portion of said first path.

7. The machine of claim 5, further comprising a conveyor having a succession of receptacles and means for moving said receptacles along a third path having a predetermined portion adjacent the second portion of said first path, successive receptacles which enter said portion of said third path being in register with successive pockets which enter the second portion of said first path and said pushers being operative to expel commodities from the respective pockets into registering receptacles.

8. The machine of claim 7, for making packs from blanks having portions which project from the respective pouches, further comprising means for folding projecting portions of blanks over the commodities in the respective pockets during transport of pockets and commodities to the second portion of said first path so that folded blanks are expelled from their pouches into the receptacles in said portion of the third path jointly with the respective commodities.

9. The machine of claim 8, wherein said moving means includes means for continuously moving receptacles along said third path and further comprising conveyor means having a plurality of second receptacles and means for continuously moving said second receptacles along a fourth path having a portion adjacent a second portion of said third path, said conveyor further comprising means for expelling commodities and blanks from receptacles in the second portion of said third path into second receptacles in said portion of said fourth path.

10. The machine of claim 1, wherein said transporting means defines an endless first path and includes a discrete transporting element for each of said pockets, said transporting means further comprising means for driving said transporting elements at a varying speed along said first path.

11. The machine of claim 10, further comprising a conveyor having a series of receptacles and means for continuously moving said receptacles at a predetermined speed along a third path having a predetermined portion which is adjacent a portion of said first path and wherein said transporting elements are driven at said predetermined speed prior to deceleration of said transporting elements in the next-following portion of said first path.

12. The machine of claim 1, further comprising a first conveyor having first receptacles and means for continuously moving said receptacles along an endless third path, means for expelling commodities and blanks from said pockets into said first receptacles, rotary conveyor means including second receptacles and means for continuously moving said second receptacles along an endless fourth path having a first portion adjacent a portion of said third path, means for expelling commodities and blanks from the first receptacles into the second receptacles, a second conveyor having third receptacles and means for continuously moving said third receptacles along and endless fifth path having a portion adjacent a second portion of said fourth path, and means for expelling commodities and blanks from said second receptacles into said third receptacles.

13. The machine of claim 12, further comprising means for feeding second blanks for successive second receptacles in said fourth path.

14. The machine of claim 13, further comprising second rotary conveyor means including fourth receptacles and means for continuously moving said fourth receptacles along an endless sixth path having a first portion adjacent a second portion of said fifth path, means for expelling commodities and blanks from third receptacles into fourth receptacles, means for feeding third blanks to said fourth receptacles, a third conveyor having fifth receptacles and means for moving said fifth receptacles along an endless seventh path having a portion adjacent a second portion of said sixth path, and means for expelling commodities and blanks from said fourth receptacles into said fifth receptacles.

15. The machine of claim 1, comprising a series of second pockets for discrete commodities, second transporting means for transporting said second pockets in a second predetermined direction along a second first path, each of said second pockets having a side extending substantially transversely of said second direction, a second pouch provided on said second transporting means in substantial parallelism with the side of each of said second pockets, and means for supplying blanks into said second pouches along another second path.

16. The machine of claim 15, further comprising a conveyor having a succession of receptacles and means for moving said receptacles along an endless path having portions adjacent said first paths, and means for expelling commodities from said pockets in said first paths into said receptacles.

17. The machine of claim 1, further comprising first, second and third endless conveyors having receptacles for commodities and blanks, means for expelling commodities and blanks from said pockets into the receptacles of said first conveyor, first rotary conveyor means for transferring commodities and blanks from the receptacles of said first conveyor into the receptacles of said second conveyor, second rotary conveyor means for transferring commodities and blanks from the receptacles of said second conveyor into the receptacles of said third conveyor, means for feeding additional blanks to said second rotary conveyor means for transfer to the receptacles of said third conveyor, and means for folding blanks on said third conveyor.

18. A machine for making packs from thin sheet-like flexible blanks and block-shaped commodities including arrays of rod-shaped articles of the tobacco processing industry, comprising a series of pockets for discrete commodities; means for transporting said pockets in a predetermined direction along a first path, each of said pockets having a side extending substantially transversely of said direction; a pouch provided on said transporting means in substantial parallelism with said side of each of said pockets; means for supplying blanks into said pouches along a second path so that portions of blanks project from the respective pockets, said pockets defining narrow compartments for discrete blanks and each of said pouches being adjacent said side of a different one of said pockets; means for delivering commodities into successive pockets in a first portion of said first path; means for expelling commodities from successive pockets in a second portion of said first path, said expelling means comprising discrete pushers in said pockets and means for moving said pushers with reference to the respective pockets; a conveyor having a succession of receptacles; means for continuously moving said receptacles along a third path having a predetermined portion adjacent the second portion of said first path, successive receptacles which enter said portion of said third path being in register with successive pockets which enter the second portion of said first path and said pushers being operative to expel commodities from the respective pockets into registering receptacles; means for folding projecting portions of blanks over the commodities in the respective pockets during transport of pockets and commodities to the second portion of said first path so that folded blanks are expelled from their pouches into the receptacles in said portion of said third path jointly with the respective commodities; and conveyor means having a plurality of second receptacles and means for continuously moving said second receptacles along a fourth path having a portion adjacent a second portion of said third path, said conveyor further comprising means for expelling commodities and blanks from receptacles in the second portion of said third path into second receptacles in said portion of said fourth path, said conveyor further comprising a concave first section which defines said predetermined portion of said third path and overlies said first path and a concave second section which defines said second portion of said third path and overlies said fourth path.

19. A machine for making packs from flexible blanks and block-shaped commodities including arrays of rod-shaped articles of the tobacco processing industry, comprising a series of pockets for discrete commodities; means for transporting said pockets in a predetermined direction along a first path, each of said pockets having a side extending substantially transversely of said direction; a pouch provided on said transporting means in substantial parallelism with said side of each of said pockets; means for supplying blanks into said pouches along a second path; rotary conveyor means including a series of receptacles and means for moving said receptacles along an endless path, said conveyor means having a peripheral surface and said receptacles being spaced apart from each other and extending from said peripheral surface substantially radially inwardly of said conveyor means; means for transferring blanks and commodities from said pockets and the respective pouches into said receptacles; a source of second blanks; means for feeding second blanks to said peripheral surface between successive receptacles of said series; means for removing successively fed second blanks from said peripheral surface; and means for returning the removed second blanks to said conveyor means so that each returned second blank overlies said peripheral surface and one of the receptacles.

20. The machine of claim 19, wherein at least one of said removing and said returning means defines for second blanks an additional path having an inlet and an outlet at different parts of said endless path.

21. The machine of claim 20, wherein at least one of said removing and returning means comprises at least one roller.

22. A machine for making packs from flexible blanks and block-shaped commodities including arrays of rod-shaped articles of the tobacco processing industry, comprising a series of three pockets for discrete commodities; means for delivering commodities only into said pockets means for transporting said pockets in a predetermined direction along a first path, each of said pockets having a side extending substantially transversely of said direction; a pouch provided on said transporting means in substantial parallelism with said side of each of said pockets, said transporting means comprising a discrete transporting element for each of said pockets and the corresponding pouch and means for rotating said elements about a common axis, said rotating means including a discrete shaft for each of said elements and each of said shafts being connected with the respective element, said shafts being rotatable relative to each other about said common axis and one of said shafts being surrounded by another of said shafts, said other shaft being surrounded by the third of said shafts; and means for supplying blanks into said pouches along a second path.

23. The machine of claim 22, wherein said rotating means further comprises a lever for each of said shafts, said levers and the respective shafts having mating toothed portions, means for orbiting said levers about said axis, and cam and follower means for pivoting said levers during orbital movement about said axis.

* * * * *